United States Patent [19]

Avery

[11] Patent Number: 4,516,722

[45] Date of Patent: May 14, 1985

[54] SNOW-MAKING NOZZLE

[75] Inventor: Joseph J. Avery, Rutland, Vt.

[73] Assignee: Sherburne Corporation, Killington, Vt.

[21] Appl. No.: 525,326

[22] Filed: Aug. 22, 1983

[51] Int. Cl.[3] ..... F25C 3/04

[52] U.S. Cl. ..... 239/14; 239/428; 239/430; 239/433

[58] Field of Search ..... 239/2 S, 14, 422, 428, 239/430, 433; 62/74

[56] References Cited

U.S. PATENT DOCUMENTS

| | | | |
|---|---|---|---|
| 220,006 | 9/1879 | Warden | 239/430 |
| 1,285,952 | 11/1918 | De Ros | 239/422 |
| 3,829,013 | 8/1974 | Ratnik | 239/14 |
| 3,881,656 | 5/1975 | Markfelt et al. | 239/428 |
| 4,145,000 | 3/1979 | Smith et al. | 239/14 |
| 4,214,700 | 7/1980 | Vanderkelen | 239/14 |
| 4,383,646 | 5/1983 | Smith | 239/14 |

*Primary Examiner*—Jeffrey V. Nase
*Assistant Examiner*—Michael J. Forman
*Attorney, Agent, or Firm*—McCormick, Paulding & Huber

[57] ABSTRACT

A continuously convergent nozzle structure for mixing water into an air stream so that small streams of water entering the nozzle adjacent its exit end are broken up into particles and projected outwardly in a fan-shaped pattern to form snow on a ski slope.

7 Claims, 6 Drawing Figures

SNOW-MAKING NOZZLE

This invention relates generally to distribution nozzles for producing snow from a mixture of compressed air and water. More particularly, the present invention relates to an improved nozzle structure which permits less compressed air to be used in producing a moisture laden spray of small uniformly sized microscopic water particles, and imparting sufficient velocity to these particles to assure that they freeze in the ambient air before reaching the ski slope or the like.

The nozzle structure includes a continuously converging nozzle which changes shape along its length from that of a circular air inlet into a thin fan-shaped outlet of rectangular configuration. The resulting flat spray of water particles and air thereby provides a wide horizontal dimension but has a relatively small vertical dimension assuring that the spray is spread efficiently into the atmosphere for the production of snow on the ski slope. The water is introduced through inclined nozzle ports which are spaced inside the rectangular outlet such that the streams of water from these ports intercept the flow of compressed air and are efficiently broken up by the air for purposes of spraying the resulting air and water mixture in the fan-shaped configuration referred to above. The top and bottom nozzle defining portions may be arranged symmetrically about a plane through the longitudinal axis of the air passageway itself, and the water ports are preferably spaced equally along both longer side walls of the rectangular nozzle structure. The axes of these water ports are preferably located well inside the rectangular outlet of the nozzle such that these ports are spaced vertically from one another by a dimension X approximately equal to the longitudinal spacing of the port axes from the rectangular nozzle outlet.

These water ports are also arranged arcuately in the nozzle structure and are inclined as mentioned previously so that the water streams do not tend to converge on one another after they emanate from the vertically spaced water ports. It is a feature of the present invention that the total included angle of these water ports actually diverges from the slight horizontal divergence for the exit portion of the air passageway in the nozzle, with the result that the water spray can be focused into a more narrow air divergent angle without losing the separation of the individual water streams. This provides a more concentrated, internally separated spray, than has been possible heretofore with prior art nozzle structures generally.

The present invention resides in a system for making snow from a mixture of compressed air and water piped to the nozzle structure in a conventional fashion. The improved nozzle structure of the present invention includes internal means comprising an extension of the air inlet pipe itself, and defining a longitudinally extending air passageway with a generally cylindrical inlet end adapted to mate with and to facilitate connection with a source of compressed air. This air passageway also includes an adaptive portion which fares this cylindrical shape into a generally rectangular cross section at the outlet, such that the ratio of the longer side to the shorter side of the rectangular outlet is in the range of at least ten to one. The outlet is thus wider than it is high and the top and bottom walls of the nozzle structure form a continuously converging nozzle without any throat or venturi, as taught for example in the prior art.

See patents such as U.S. Pat. Nos. 4,145,000 and 4,383,646 both issued to Smith. The present invention avoids the convergentdivergent nozzle configuration considered by Smith to be essential to the proper mixing of the air and water in a snow making nozzle, and as an adjunct to the elimination of a throat in the nozzle structure of the present invention it has been found that the nozzle operates with lower air flow requirements than is true of snow making nozzles of the type proposed by Smith. It has also been found that the continuously converging nozzle is less objectionable in operation from the point of view of noise. Other advantages of the present invention over the snow making nozzles shown in the Smith patents can be attributed to the unique geometry for the nozzle structure itself wherein connection of the air and the water lines is greatly facilitated, and wherein the size and weight of the resulting nozzle structure lends itself to greater ease in manipulation and transport to and from locations on the ski slope. Since these nozzles must be moved about to provide a blanket of snow at any given ski slope this task of transporting and setting up the nozzles must be undertaken in adverse weather conditions. It is an important advantage to provide a compact snow making nozzle of mimimum weight capable of operation under a variety of conditions and well suited to connecting and disconnecting from conventional air and water lines.

It is an important feature of the present invention, therefor, that no throat or venturi is defined in the nozzle structure, and that the water ports are spaced from one another by a dimension that is approximately equal to the longitudinal spacing of such ports from the outlet of the nozzle itself. This geometry has been found to provide improved operation in a continuously converging snow gun nozzle of the type described herein.

It is a further feature of the present invention that the water ports have their individual inclined axes emanating from the sides of the nozzle structure along an arc with approximately the same center as that for the radius of curvature for the nozzle outlet opening itself. Furthermore, these nozzle water ports are equally spaced with respect to one another and have a bore or diameter of approximately three thirty seconds (3/32) of an inch. If these water ports are spaced equally from one another by a distance no greater than 1.5 time this diameter a mixture of the water and air is achieved such that the use of compressed air is minimized for a given quantity of water injected through these water ports without adverse effect upon the quality of the snow so produced. The radius of curvature for the outlet of the nozzle, together with its corresponding arc length dimension, define a central angle D such that the water ports inclined away from a vertical plane through the plane of symmetry for the nozzle structure at an angle B, greater than D, with the result that a more efficient mixing of the air and water emanating from the nozzle outlet is achieved.

DETAILED DESCRIPTION

Figure 1:
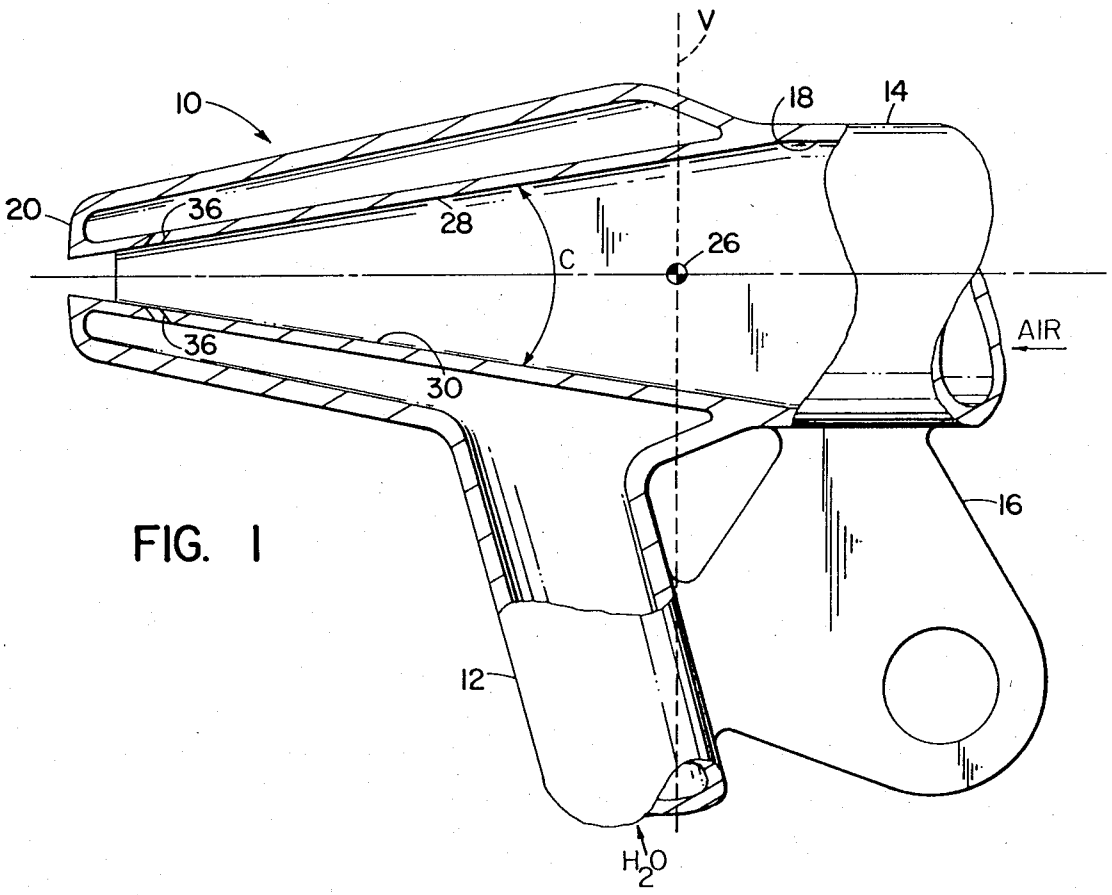
FIG. 1 is a vertical sectional view through a snow making nozzle structure incorporating the present invention.

Turning now to the drawings in greater detail, FIG. 1 shows a nozzle structure 10 having a water inlet conduit 12 and an air inlet conduit 14 oriented at substantially right angles to one another so that a bracket 16 can be welded therebetween for convenience in mounting the nozzle structure to a portable stanchion or other framework.

Figure 2:
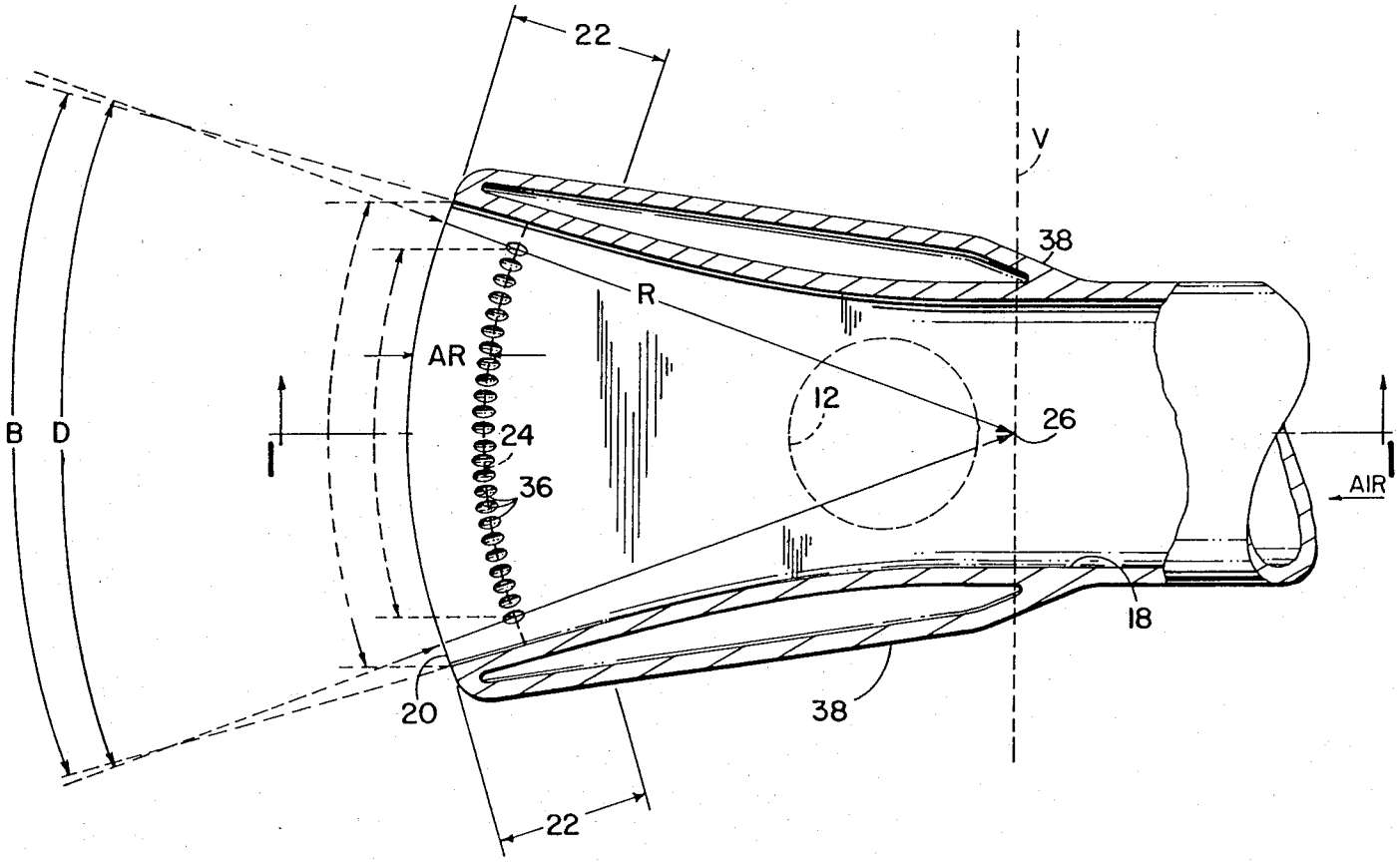
FIG. 2 is a horizontal sectional view, being taken generally on the line 2—2 of FIG. 1.
Figure 3:
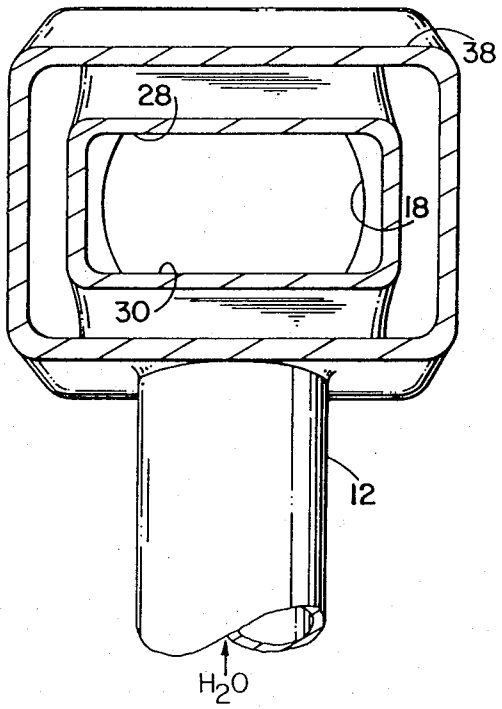
FIG. 3 is a vertical sectional view taken generally on the line 3—3 of FIG. 2.

The nozzle structure 10 more particularly includes internal means defining a longitudinally extending air passageway with a generally cylindrical inlet end portion 18 corresponding in size and cross sectional shape to the compressed air conduit portion 14. As best shown in FIG. 3 this cylindrical inlet end portion of the air passageway defining means widens or diverges in the horizontal section of FIG. 2 and it is a feature of the present invention that the exit or outlet end of this air passageway means is convex, as shown at 20, and that segment 22 thereof is generally linear being defined by planar side walls in the area where the water outlet ports, to be described, discharge the water into the air stream. The radius of curvature of the convex outlet end 20 of the nozzle structure is indicated generally at R in FIG. 2 with the dimension $\Delta R$ indicating the spacing provided between the water outlet ports and the outlet itself.

Figure 4:
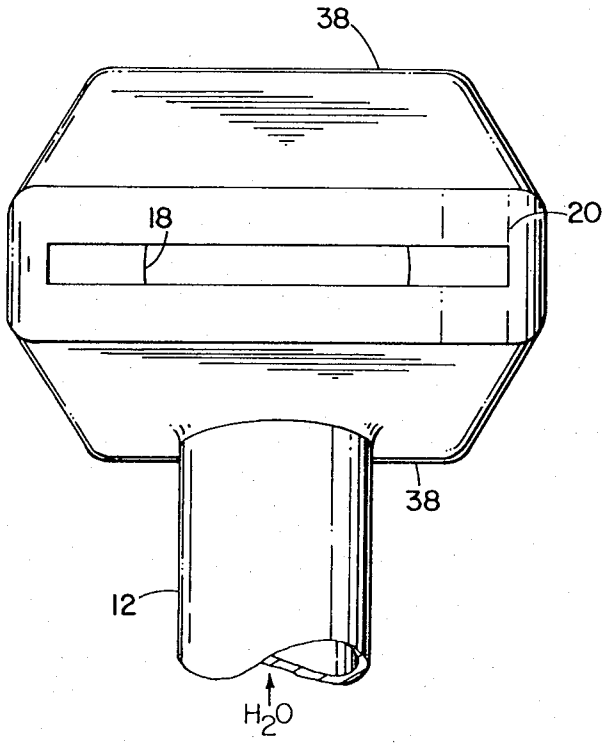
FIG. 4 is a front view of the nozzle structure.

As so constructed and arranged the air passageway changes in cross sectional shape from the cylindrical inlet end configuration suggested at 18 to a generally rectangular shape as best shown at FIG. 4. FIG. 3, for example, illustrates the cross sectional shape of the passageway at an intermediate station located generally in the same vertical plane as the center 26 for the radii of curvature R and $R + \Delta R$. FIG. 1 shows this vertical plane at V and it is noted that this plane V is located longitudinally on the axis of the air passageway defining means as is the line 3—3 of FIG. 2 from which FIG. 3 is taken.

As best shown in FIG. 1 the continuously converging generally rectangular air passageway is defined by upper and lower tapered wall portions 28 and 30 respectively. These upper and lower plates define the continuously converging nozzle, and Fig. 2 shows the extent to which these opposed longer side walls of the generally rectangular nozzle shape are effected by the relatively short side walls to achieve the rectangular outlet configuration and to impart to the air and water mixture the fan-shaped spray pattern suitable for the laying down a blanket of snow on a ski slope.

Figure 6:
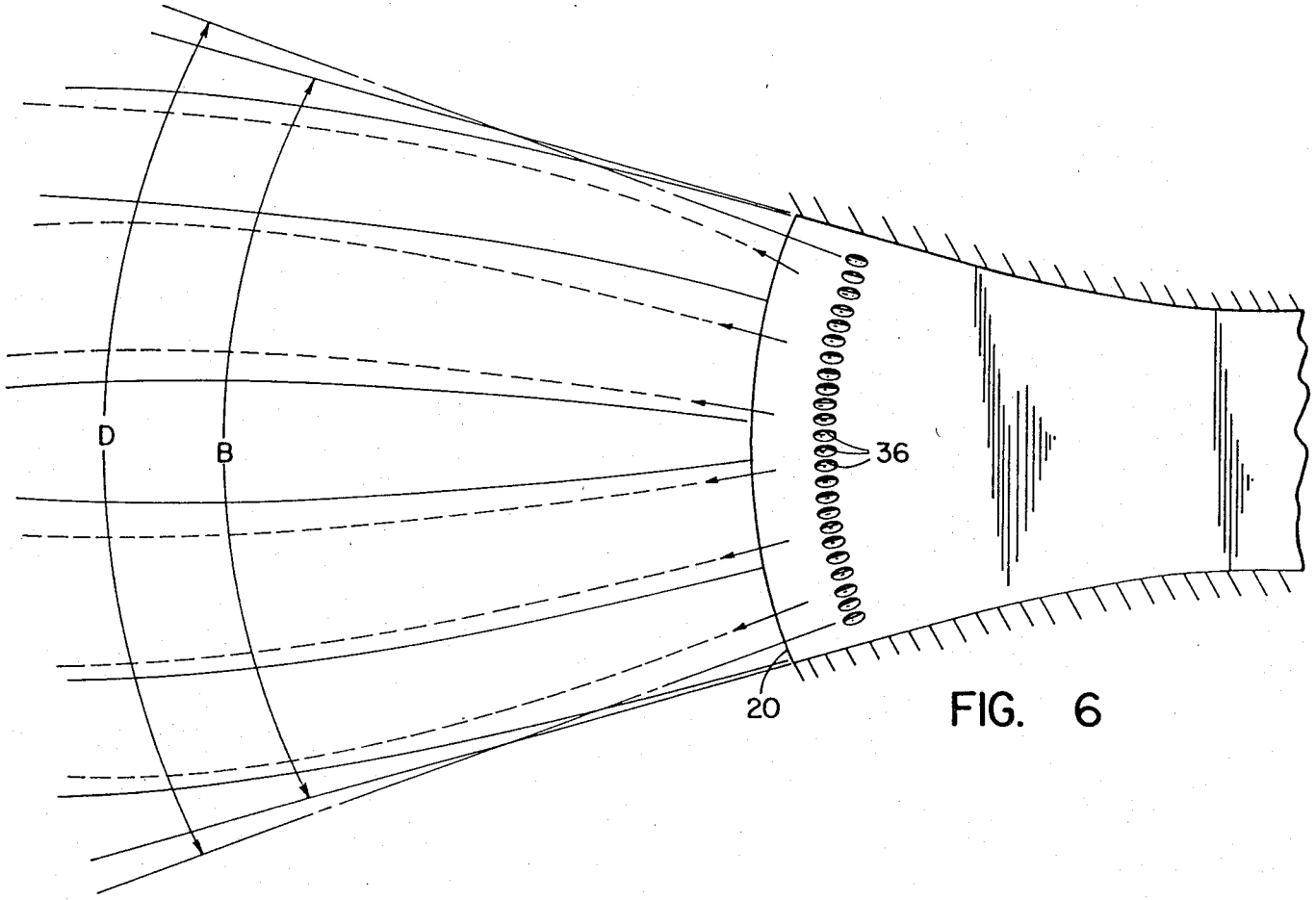
FIG. 6 is a horizontal sectional view showing in schematic fashion the relative directions of the water and air stream lines emanating from the nozzle structure.

Water outlet ports 36, 36 are drilled into the upper and lower nozzle walls at an angle E of approximately 40 degrees with respect to the longitudinal axis of the air passageway. This angle is preferably in the range between 35 and 50 degrees with respect to a generally horizontal plane of symmetry through the longitudinal axis of the air passageway, and these ports are also spaced equally along the longer rectangular side walls of the nozzle structure as best shown in FIG. 2. Furthermore, each such water port is drilled at an angle both to the forementioned horizontal plane, and also at an angle with respect to a vertical plane through this longitudinal axis. The outermost ports are drilled at an included angle D as best shown in FIG. 6 which is approximately 30 percent greater than the included angle B for the air passageway outlet itself. This geometry assures that the streams of water emanating from the nozzle remain separated after entering the air stream, and that the air stream in the narrower and less divergent fan-shaped passageway results in a more focused spray of water particles and air better suited to the manufacture of artifical snow. The broken streamlines in FIG. 6 represent the flow of water and the solid stream lines represent the flow of air.

Each water port 36 preferably has a diameter of approximately three thirty second (3/32) of an inch, and it is a feature of the present invention that the spacing between these ports may be only 1.5 times this diameter. Such spacing is preferably no more than one eighth ($\frac{1}{8}$) of an inch, and it will be apparent that the divergence angle D for the outermost ports in the line of ports is considerably greater than the divergence angle B for the air exiting the nozzle.

Figure 5:
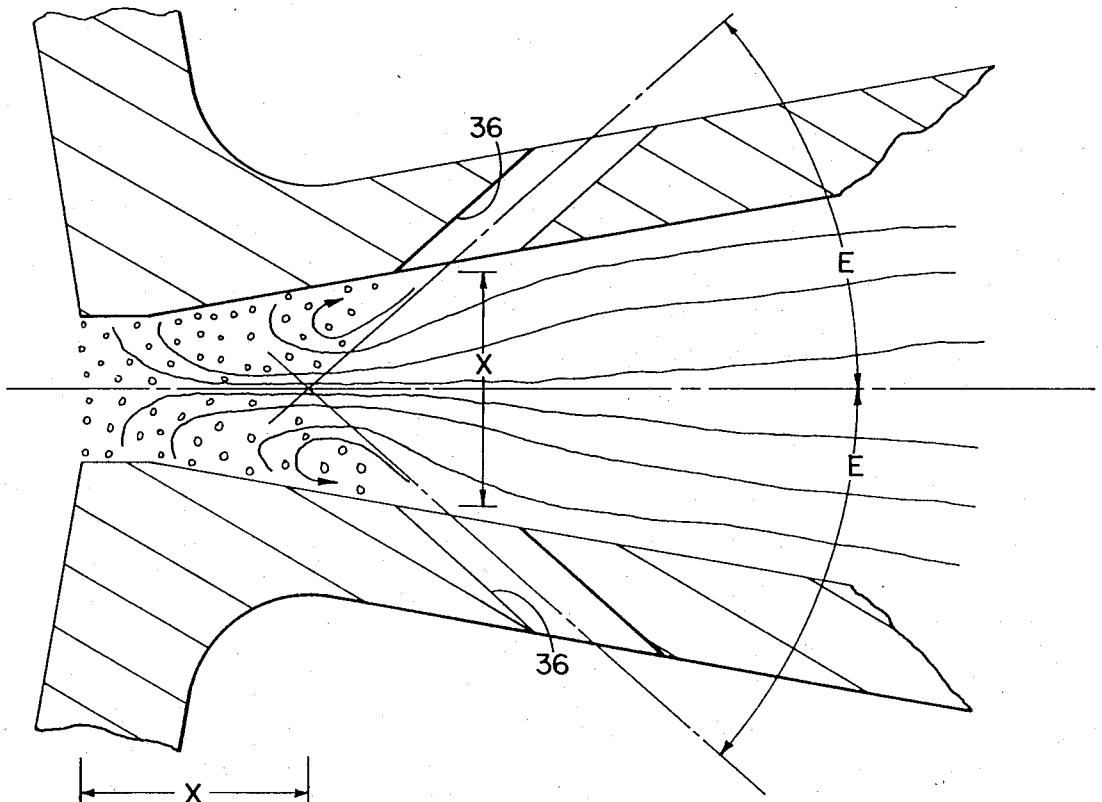
FIG. 5 is a vertical sectional view showing in schematic fashion the mixing area of the nozzle to a somewhat larger scale and showing the spacing X between the upper and lower water ports which is approximately the same as the linear distance provided between the outlet end of the nozzle and the area where the axes of these water ports converge.

With particular reference to FIG. 5, the nozzle structure of the present invention is there shown in schematic fashion with streamlines representing the flow of air through the continuously converging exit end of the nozzle, and with short arrows to indicate the linear streams of water from each of the opposed water ports 36. Providing these ports in vertically spaced relationship to one another by a dimension X approximately the same as that of linear spacing between the point of convergence for the axes of these water ports and the outlet of the nozzle. This geometry tends to constrict or block the flow of air so that air pressure is required to break up the streams of water and to form the small particles of water so necessary to the process of making snow. The steeply inclined angle E for each of these water ports assures that the water streams do not excessively block the air passageway, and also assures that the streams of water assist in accelerating the water and air mass in the desired downstream direction of motion within the nozzle structure. As the water particles are accelerated in the continuously converging exit portion of the nozzle the formation of ice crystals is facilitated, and a rapid expansion occurs at the exit end of the nozzle further contributing to the cooling effect on the water particles so as to enhance the formation of ice crystals or snow.

With particular reference to FIG. 6, the angle D being greater than the angle B assures that water streams emanating from the ports are not drawn together as they enter the more restrictive area at the exit end of the nozzle structure. By reducing or narrowing the air angle relative to that of the water ports the overall spray pattern of the water does not diverge excessively and tends to bend back into alignment with the air stream as it passes through the zone of contraction of the air-water plume. Resulting portions of the plume provide a good air/water mass concentration which develops good momentum and "throw" for the plume as it is projected into the ambient air. The desired degree of water separation is achieved in the fan-shaped pattern necessary for good snow making.

In conclusion then it is important for the nozzle to maintain as high a degree of forward momentum and a concentration of the air and water as possible, and to nevertheless achieve the water mass separation. The generally fan-shaped spray pattern configuration made possible with a nozzle of the present invention makes effective use of the momentum and separation principles in a most effective combination as a result of the greater divergence angle D for the water and the slightly smaller divergence angle B for the exit end of the air passageway itself. This geometry when taken in combination with the continuously convergent configuration for the nozzle, and the spacing for the water outlet ports in this nozzle provide an improved configuration for a snow making nozzle free of the disadvantages formerly encountered with prior art snow guns, especially those with conventional convergent-divergent nozzle configurations.

I claim:

1. In a system for making snow from compressed air and water, an improved nozzle structure comprising:

means defining a longitudinally extending air passageway with a generally cylindrical inlet end portion for connection with a source of air under pressure, said air passageway including an outlet of generally rectangular cross section and with the ratio of the longer side of said outlet to the shorter side of said rectangular outlet being in the range of at least ten to one, said air passageway further including an intermediate portion between said air inlet and outlet, said intermediate portion being of rectangular cross section with side walls arranged in opposed pairs, one pair being longer than the other, said longer pair of said pairs of opposed side walls continuously converging in a downstream direction to form the longer sides of said generally rectangular outlet and the other pair of opposed side walls diverging in said downstream direction to form the shorter sides of said rectangular outlet, housing means defining a water jacket surrounding said intermediate passageway portion and including at least one water inlet opening for connection with a source of water under pressure, and a plurality of water ports opening into said air passageway at said longer sides, all of said water ports having its axis inclined in said downstream direction at an angle in the range between 35 to 40 degrees with respect to a horizontal plane of symmetry through said longitudinal axis of said air passageway, all ports being equally spaced from one another along a line in each of said longer side walls, and said port axes located in vertically opposed relation so that said opposed ports are spaced from one another vertically inside said outlet in said opposed side walls by a dimension X at least approximately equal to the longitudinal spacing of the intersection of the port axes from said outlet.

2. The combination of claim 1 wherein said outlet terminates in a convex surface having a radius of curvature R and an arc length L at least slightly less than R, and said side walls defining said water ports also having a curved contour with a radius of curvture $R-\Delta R$ such that said ports are spaced longitudinally from said convex surface of said outlet by the dimension $\Delta R$, said radius R having a center located on a plane through said longitudinal passageway axis that is perpendicular to said plane of symmetry.

3. The combination of claim 2 wherein said radius of curvature R and its corresponding arc length dimension L define a central angle B for said outlet end portion of said air passageway, said water inlet ports being in the form of cylindrical bores in the longer side walls of said intermediate air passageway portion, said endmost water inlet ports having bore axes which diverge away from a vertical plane through said longitudinal axis at an angle D and in the downstream direction of said air passageway from a point which is located at least approximately on a vertical line through the center of said radius R of curvature for said convexly contoured outlet end portion, and said angle D being greater than said angle B.

4. The combination of claim 3 wherein said water ports are so sized and spaced that the ratio of such spacing to the diameter of said port is approximately 1.5 to 1.

5. The combination of claim 3 wherein said water ports have a diameter of approximately three thirty seconds (3/32) of an inch.

6. The combination of claim 3 wherein said water ports are spaced from one another by a distance of no more than one eighth ($\frac{1}{8}$) of an inch.

7. The combination of claim 3 wherein said water ports are so spaced and wherein said ports describe an arc in said longer passageway sides, the central angle D defined by the endmost ports has approximately the same center as that for said radius of curvature R, and said continuously diverging shorter side walls of said air passageway defining a central angle B, which angle B is smaller than said central angle D defined by said outermost water ports.

* * * * *